US008294884B2

(12) United States Patent
Buehlmann

(10) Patent No.: US 8,294,884 B2
(45) Date of Patent: Oct. 23, 2012

(54) SIDEWAYS DRIFT CORRECTION DEVICE

(75) Inventor: Andreas Buehlmann, Merligen (CH)

(73) Assignee: Leica Geosystems AG, Heerbrugg (CH)

( * ) Notice: Subject to any disclaimer, the term of this patent is extended or adjusted under 35 U.S.C. 154(b) by 189 days.

(21) Appl. No.: 12/599,482

(22) PCT Filed: May 8, 2008

(86) PCT No.: PCT/EP2008/003700

§ 371 (c)(1),
(2), (4) Date: Apr. 6, 2010

(87) PCT Pub. No.: WO2008/138542

PCT Pub. Date: Nov. 20, 2008

(65) Prior Publication Data

US 2010/0201994 A1 Aug. 12, 2010

(30) Foreign Application Priority Data

May 10, 2007 (EP) ..... 07107972

(51) Int. Cl.
*G01B 9/00* (2006.01)

(52) U.S. Cl. ..... 356/124

(58) Field of Classification Search ..... 356/615, 356/124

See application file for complete search history.

(56) References Cited

U.S. PATENT DOCUMENTS

| | | | | |
|---|---|---|---|---|
| 5,988,936 | A | 11/1999 | Smith | |
| 2001/0027892 | A1 * | 10/2001 | Masters et al. | 180/403 |
| 2004/0221790 | A1 * | 11/2004 | Sinclair et al. | 116/62.1 |

FOREIGN PATENT DOCUMENTS

EP 0620319 A1 10/1994

* cited by examiner

*Primary Examiner* — Tarifur Chowdhury
*Assistant Examiner* — Abdullahi Nur
(74) *Attorney, Agent, or Firm* — Maschoff Gilmore & Israelsen

(57) ABSTRACT

The invention relates to a sideways drift correction device for a mobile production machine comprising a removal of material and a tool for processing the removed material, having a sensor component and an evaluation component. The sensor component detects the structure of at least one part of the underground surface relative to which the production machine moves. The evaluation component determines the relative motion direction of a reference point on the production machine relative to the subsoil from the time-variable information of the underground surface, and derives steering correction information therefrom.

13 Claims, 6 Drawing Sheets

SIDEWAYS DRIFT CORRECTION DEVICE

The invention relates to a sideways drift correction device for a mobile construction machine which comprises application of material and tool for processing the applied material, according to the precharacterizing clause of claim 1.

Mobile machines for the construction of curbs or paths have long been known. The sliding construction is usually effected in three steps: application of material, such as, for example, concrete, coarse shuttering of the material and fine shuttering of the material. All three steps are carried out while such a machine is travelling, for example by appropriate sliding formworks. The travelling speed of the machine during construction may be about 20 meters per minute. Any deviation of the course of the mobile machine specified for construction can give rise to an error in the structure to be constructed by the tool. A sideways drift, especially in the case of machines with sliding shuttering, such as, for example, a curb & gutter machine, when travelling around curves is therefore disadvantageous.

In general, construction machines with sliding shuttering which can also travel with tight radii have three or four caterpillar undercarriages, these all being capable of being steered. To ensure that the construction tool does not experience a sideways movement when steering the front undercarriages, counter-steering of the rear undercarriage is necessary.

Devices known to date for detecting and preventing a sideways drift of mobile construction machines comprise the steering angle measurement of the caterpillar undercarriages of the machine in order to calculate the orientation and the track covered by the machine and to calculate steering corrections therefrom. However, it is generally not possible to assume that the machine does not in fact shift sideways over the caterpillar undercarriages. Such a shift means a sideways movement for the construction tool mounted on the machine and therefore inaccurate production of the structure to be produced. By measuring only the steering angles of the caterpillar undercarriages, such a sideways drift remains unnoticed.

It is the object of the invention to improve a mobile construction machine and therefore to permit more precise production of a structure.

A further object of the invention is to provide a device which better detects a sideways movement of the construction tool of the mobile construction machine and if required corrects it.

A further object is the direct determination of the direction of movement of a reference point of the construction machine relative to the ground.

The sideways drift correction device according to the invention consists of a sensor component and an evaluation component. As the production machine moves forward, the direction of movement of a reference point on the machine relative to the ground is determined by the sideways drift correction device and steering correction information is derived therefrom. For this purpose, one or more reference points of the construction machine and a part of the ground surface relative to which the construction machine moves are detected by means of the sensor component and the information is transmitted to the evaluation component. The evaluation component evaluates the information of the sensor component and determines therefrom the direction of movement of the construction machine relative to the ground. For this purpose, the time-variable surface information is monitored relative to a reference point, and the direction of movement of the reference point relative to the ground is determined from the relative changes of the ground surface. The reference point may be, for example, the sensor component itself, provided that it is mounted on the machine, or a defined point on the machine or on the construction tool. The evaluation component continuously checks whether the construction machine or the construction tool is moving in a drift-free manner and derives steering correction information, it also being possible for the steering correction information to be zero.

The sensor component is mounted, for example, on the mobile construction machine, for example on an arm of the construction tool or under the bottom of the machine, and thus performs the same relative movement to the ground as a construction machine or the construction tool itself.

If the orientation of the longitudinal axis of the construction machine relative to the sensor component is known and if the evaluation component additionally continuously checks whether the sensor component is moving only in the direction of the longitudinal axis of the construction machine, it is possible, by means of appropriately derived correction information of the evaluation component, to ensure that the machine and therefore the construction tool mounted on the machine move only in the direction of the longitudinal axis of the construction machine and therefore without drift.

Advantageously, the reference point is chosen as close as possible to the tool or the sensor component is mounted as close as possible to the tool. As a result, the movement performed by the construction tool, which determines the structure to be constructed from the construction material, is represented as accurately as possible by the determined movement of the reference point relative to the ground.

A possible embodiment of the sensor component is a camera which is mounted on the construction machine and repeatedly detects a certain part of the surface of the ground. The repeated detection is advantageously effected at short time intervals, such as, for example, 10 ms. By means of the evaluation component, shifting surface features are monitored from recording to recording on the basis of image recognition by the forward movement of the camera. The shift of a detected feature in two successive recordings represents the movement performed by the camera relative to the ground. This movement is also executed by the construction machine since the camera is mounted directly on the construction machine. Thus, the direction of movement of the construction machine is continuously determined and controlled. If the machine does not move without drift, steering correction information is derived by the evaluation component.

Alternatively, mounting of the camera, for example, on a carriage travelling next to the machine, such as, for example, on a material-feeding carriage, is possible, the camera detecting a reference point on the construction machine and a part of the ground relative to which the machine is moving. Thereafter, the evaluation component derives the direction of movement of the reference point relative to the ground from the image information of the camera. The reference point may be, for example, an edge or a corner of the construction machine.

In order to improve the detection and assignment of surface features of the ground in the individual recordings and thereby to determine the direction of movement relative to the ground more precisely, illumination or brightening of the ground surface to be detected is possible. This illumination can be effected in various ways, for example with radiation in a specific spectral range or with a beam pattern projected onto the ground structure to be detected. An improvement of the detection of the ground is effected, for example, by causing uneven ground areas to throw shadows by appropriate illumination, for example with grazing incidence. The ground can also be detected by means of its radiation characteristic of the reflected radiation, for example by means of the colors of the ground surface.

A sideways drift correction device according to the invention for a mobile construction machine is described in more detail below, purely by way of example, with reference to working examples shown schematically in the drawing. Specifically, FIG. 1 shows various positions during travel around a curve by a mobile construction machine of the prior art along a specified project line;

FIG. 2 a sideways drift correction device according to the invention, mounted on a sliding formwork machine;

Figure 1:
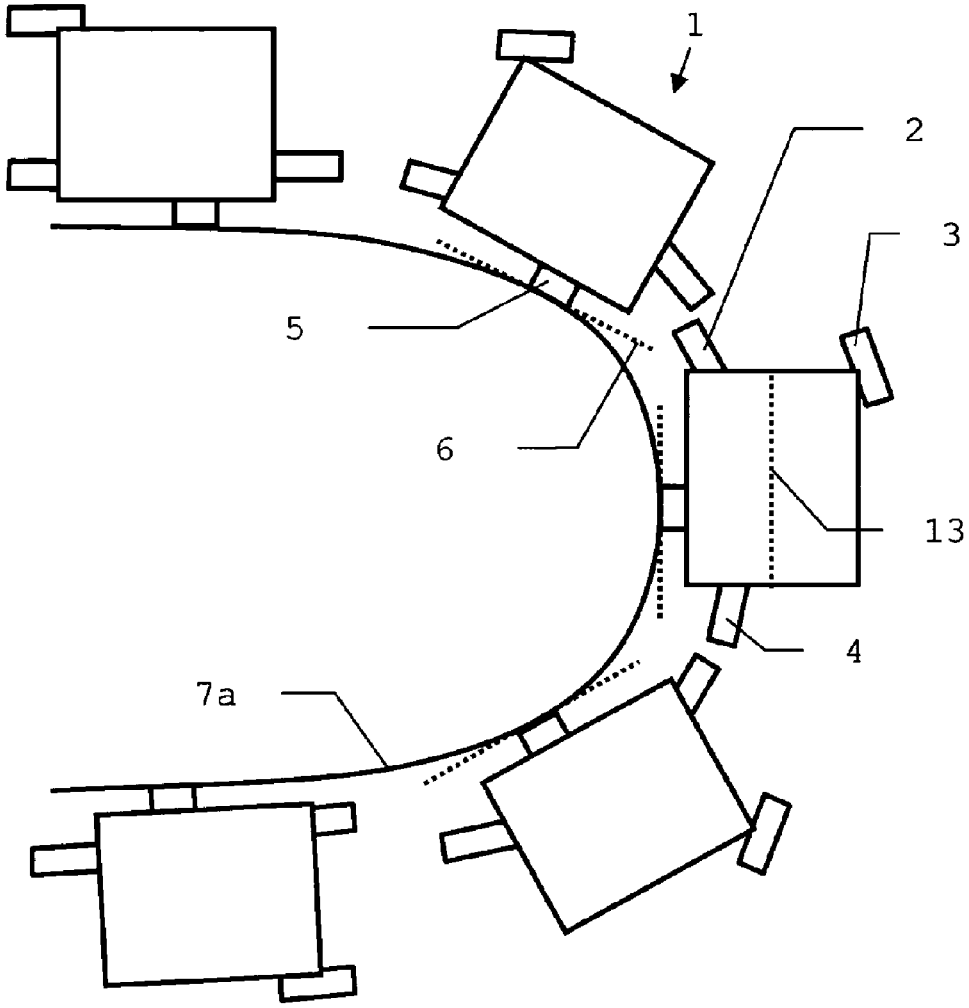

FIG. 1 shows, by way of illustration, various positions during travel around a curve by a mobile construction machine 1 of the prior art along the specified project line 7*a* of the structure to be produced. While travelling around a curve, the longitudinal axis 13 of the machine should in every position be parallel to the tangent 6 to the project line 7*a* at the point at which the tool 5 touches the project line 7*a*. In order to prevent a sideways movement of the tool, counter-steering of the rear caterpillar undercarriage 4 is necessary when steering the front caterpillar undercarriages 2 and 3 of the machine.

Figure 2:
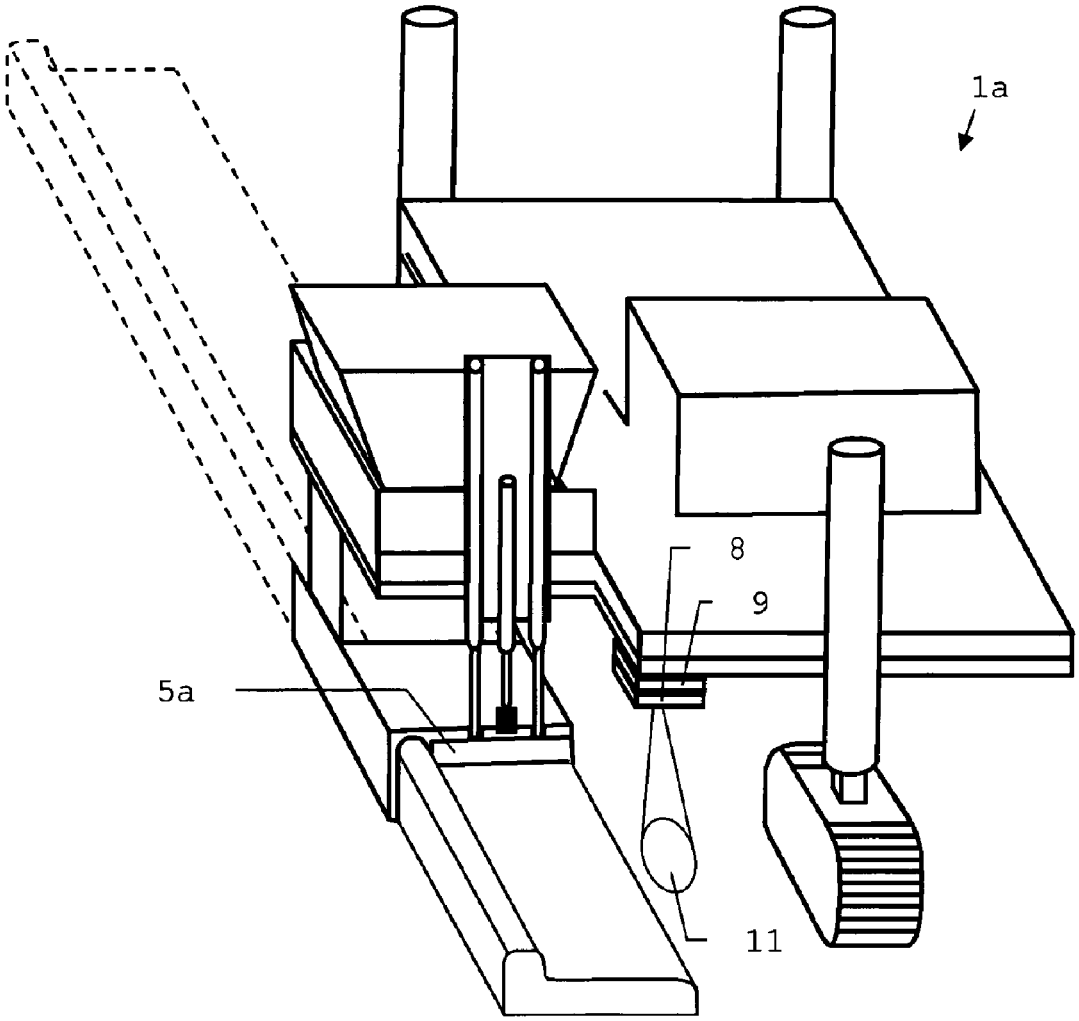

FIG. 2 shows a sideways drift correction device according to the invention, comprising a sensor component 8 and an evaluation component 9, which are mounted under the bottom of the sliding formwork machine 1*a* in the vicinity of the construction tool 5*a*. The sensor component 8 determines the surface characteristics of a part 11 of the ground covered by the construction machine and transmits the information to the evaluation component 9. On the basis of the changes in the transmitted ground surface information during the forward movement of the machine, the evaluation component 9 determines the direction of movement of the sensor component 8. Furthermore, the evaluation component 9 checks whether the sensor component 8 is moving without drift and if necessary derives therefrom steering corrections which it transmits to the steering system of the machine.

Figure 3:
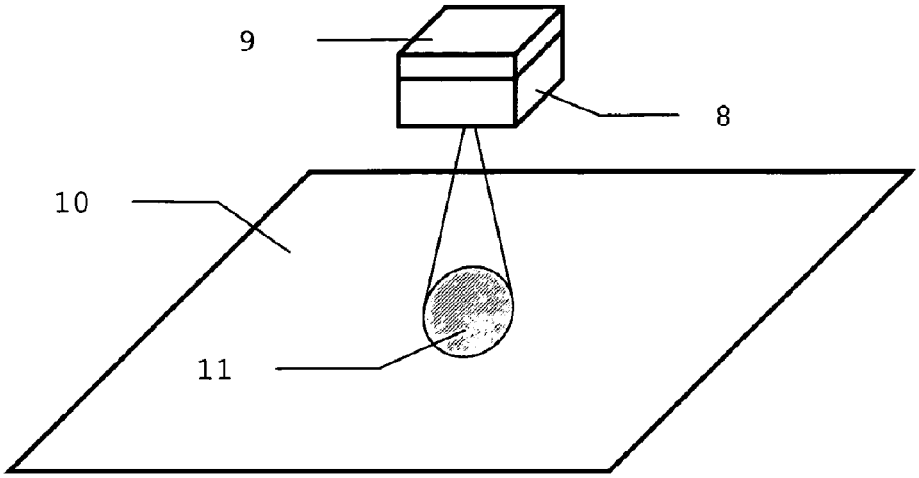
FIG. 3 shows the sensor component and the evaluation component of the sideways drift correction device and that part of the ground structure which is detected optically by the sensor component.

FIG. 3 shows a sensor component 8 which is in the form of a camera and which optically detects the ground structure of the part 11 of the ground 10 covered, with, for example, a repetition rate of 100 Hz, and transmits the information to the evaluation component 9. The evaluation component 9 determines therefrom, as shown in FIG. 4, the direction of movement, optionally also the speed and/or the distance covered by the sensor component 8 relative to the ground and stores this information.

Figure 4:
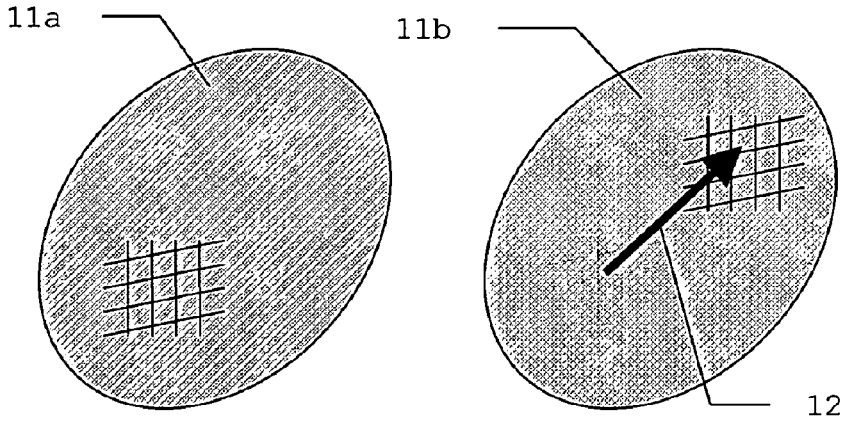
FIG. 4 shows two ground structure sections distinguished in succession by the camera as a sensor component.

FIG. 4 shows two sections 11*a* and 11*b* of the ground surface structure which are recorded in succession by means of a sensor component, not shown here, the sensor component mounted on the machine having moved forward between the recordings as a result of the forward movement of the machine. By a comparison of the two recordings 11*a* and 11*b* of the ground surface, the evaluation component determines the direction of movement 12 of the sensor component relative to the ground. For example, image recognition as part of the evaluation component follows a structural feature occurring at different positions in the recordings, the movement of the structural feature being shown as arrow 12, and determines therefrom the direction of movement of the camera relative to the ground. On the basis of this information, the evaluation component checks whether the sensor component is moving only in the direction of one axis and derives therefrom steering correction information which is transmitted to the control system of the machine.

In order to increase the speed of the ground structure detection, it is possible, for example, to identify one or more structural features on the basis of the image recognition and to monitor only the relative change in position of these identified features. A further possibility consists, for example, in the use of the template matching method.

Figure 5:
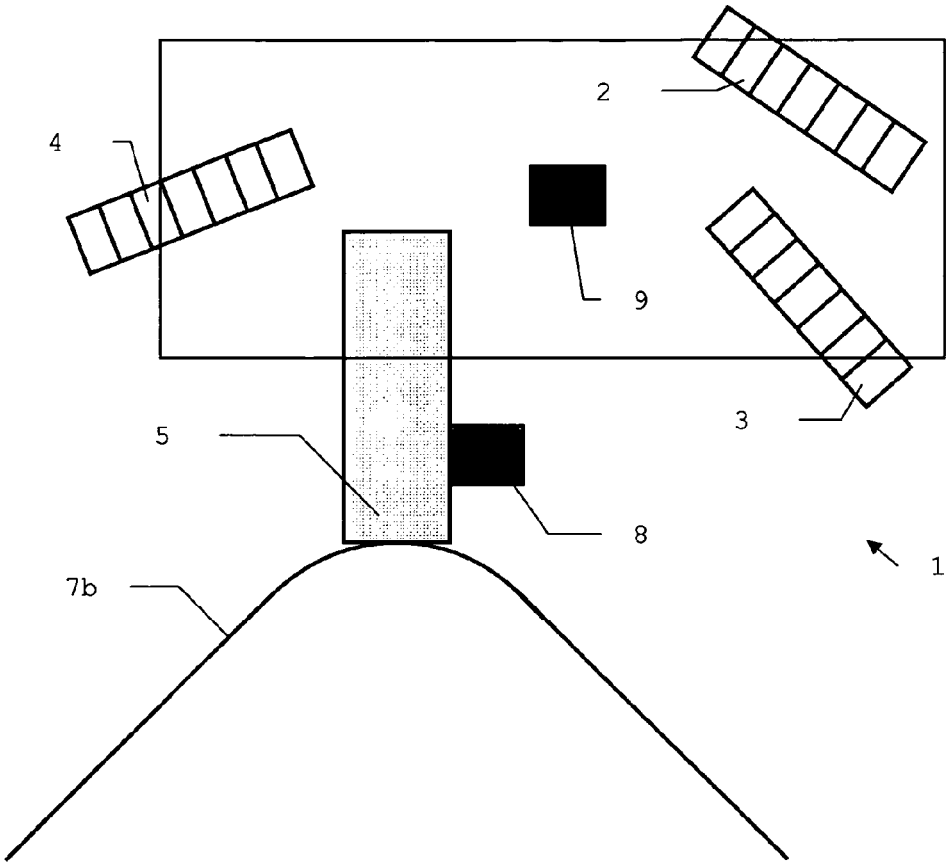
FIG. 5 shows the sideways drift correction device, mounted on a construction machine which is travelling around a curve.

FIG. 5 shows the construction machine 1 while travelling around a curve along the project line 7*b*. The sensor component 8 is mounted in a known orientation relative to the axis of the construction machine on the arm of the construction tool 5. The evaluation component 9 checks, from the detected ground surface of the sensor component 8, whether the sensor component 8 is moving only in the direction of the axis of the construction machine. From this, the evaluation component 9 derives steering correction information so that, by steering the front caterpillar undercarriages 2 and 3, the tool 5 follows the defined project line 7*b* and, by steering the rear caterpillar undercarriage 4, the sensor component 8 and therefore also the tool 5 experience no sideways movement relative to the machine axis.

Figure 6:
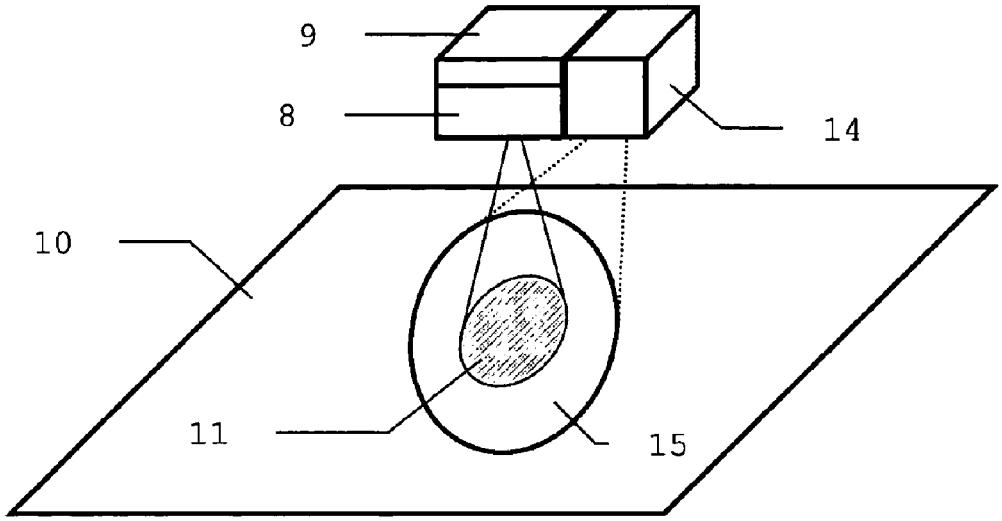
FIG. 6 shows the sideways drift correction device with an illumination component.

FIG. 6 shows the sideways drift correction device with an illumination component 14 for brightening 15 the ground structure 11 detected by the sensor component 8. The illumination of the ground structure permits, for example in the case of grazing incidence of the light, throwing of shadows of the uneven surface areas and thus improved detection of features of the ground surface. Likewise, different colors of the ground surface can be better distinguished by the illumination.

Figure 7:
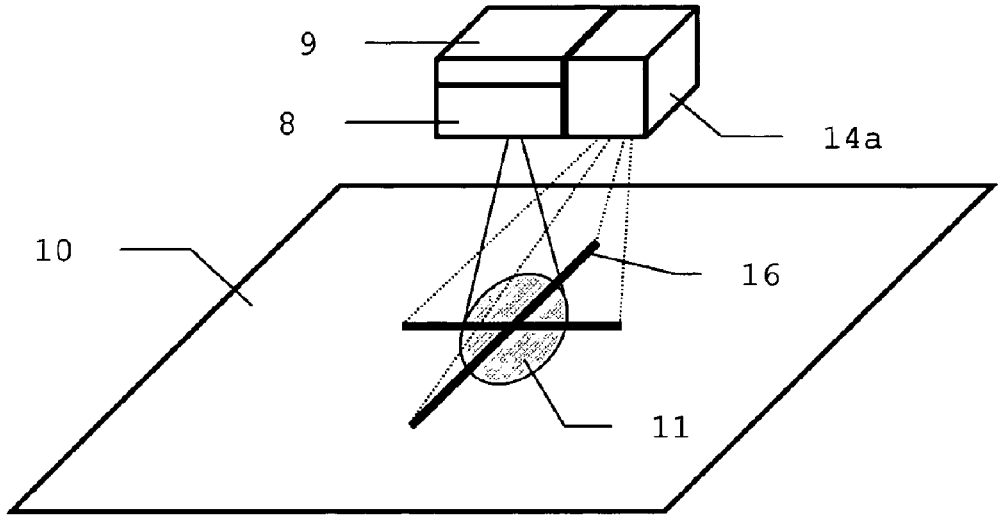
FIG. 7 shows a sideways drift correction device with an illumination component which produces a defined beam pattern.

FIG. 7 shows the sideways drift correction device with an illumination component 14*a* for defined projection of a cross 16 as a brightening structure onto a part of the ground surface 11 detected by means of the sensor component 8. One axis of the cross 16 is aligned in the direction of the axis of the construction machine, which axis is not shown. The evaluation component 9 continuously checks whether the construction machine is moving only in the direction of one axis of the cross and therefore in the direction of the machine axis and, if required, derives steering correction information therefrom.

Figure 8:
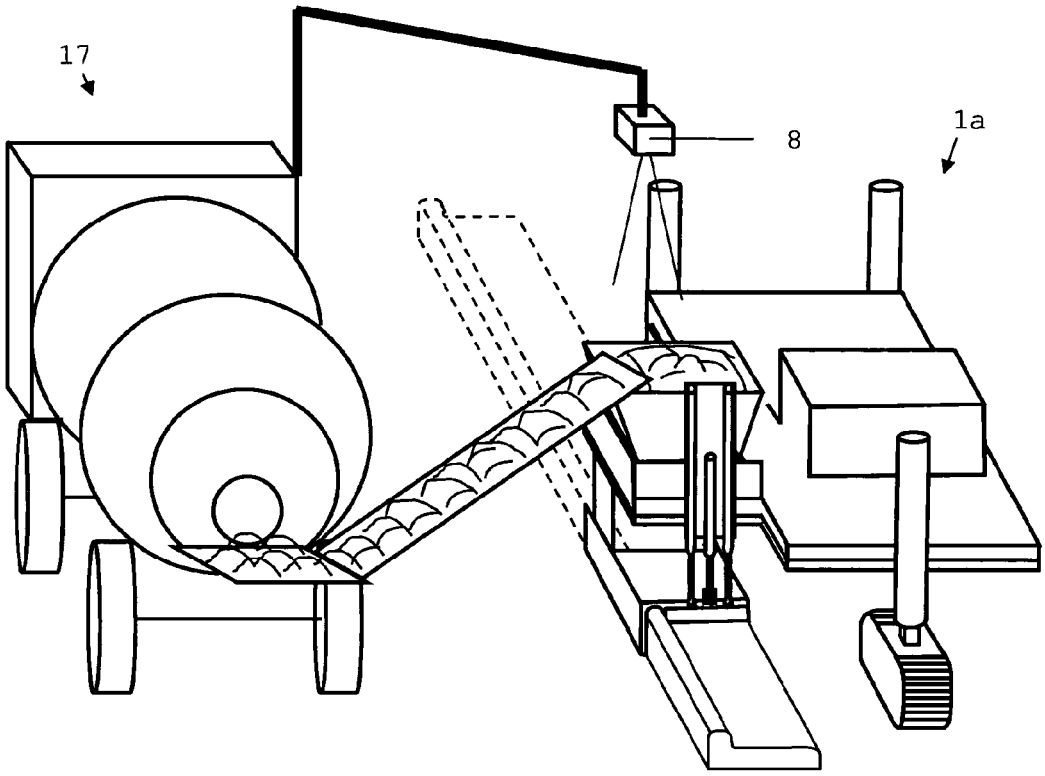
FIG. 8 shows an embodiment of the sideways drift correction device according to the invention.

FIG. 8 shows an embodiment of the sideways drift correction device in which a camera 8 as a sensor component is mounted on a carriage 17 travelling next to the machine. The camera 8 detects a corner of the construction machine as a reference point and a part of the ground surface relative to which the construction machine 1*a* is moving. The evaluation component, which is not shown, determines the direction of movement of the corner relative to the ground on the basis of this information and, if required, derives steering correction information therefrom.

Of course, these figures shown represent only examples of possible embodiments.

The invention claimed is:

1. A sideways drift correction device for a mobile construction machine which includes application of material and a construction tool for processing the applied material, comprising:

a sensor component configured for continuous detection of at least a part of the ground surface relative to which the construction machine is moving, the construction machine being moved forward between generated recordings of the ground surface; and an evaluation component configured to recognize a shift of a selected structural feature of the recorded ground surface by comparison of the recordings and for determining therefrom the direction of movement of a reference point of the construction machine relative to the ground, wherein:

the sensor component is mounted in a defined orientation relative to a longitudinal axis of the construction machine; and the evaluation component is further configured:

to continuously check whether the sensor component is moving only in the direction of the longitudinal axis of the construction machine;

to detect a sideways drift of the construction machine on the basis of the determined direction of movement of the reference point relative to the ground; and to derive steering correction information so that the sideways drift is corrected.

2. A sideways drift correction device according to claim 1, wherein the sensor component is configured to optically detect the ground surface.

3. A sideways drift correction device according to claim 1, wherein the sensor component includes a cameral to optically detect the ground surface.

4. A sideways drift correction device according to claim 3, wherein the evaluation component is provided with image recognition means for recognizing a shift of a selected structural feature of the recorded ground surface by comparison of the recordings and for determining therefrom the direction of movement of a reference point of the construction machine relative to the ground.

5. A sideways drift correction device according to claim 1, wherein the sensor component is configured to detect the ground surface with a repetition rate of at least 100 Hz.

6. A sideways drift correction device according to claim 1, wherein the sensor component is configured to detect the ground surface which is covered by the forward movement of the construction machine.

7. A sideways drift correction device according to claim 1, wherein the sensor component is mounted in or under a construction machine bottom and/or on a tool arm of the construction machine.

8. A sideways drift correction device according to claim 1, wherein the evaluation component determines the speed of movement and the path covered by the construction tool relative to the ground from the information of the sensor component and stores information about the direction of movement, and/or the speed of movement and/or the path covered.

9. A sideways drift correction device according to claim 1, further comprising an illumination component for illuminating at least a part of the ground surface detected by the sensor component or for targeted projection of an illumination structure onto at least a part of the ground surface detectable by the sensor component.

10. A sideways drift correction device according to claim 1, further comprising an illumination component for illuminating at least a part of the ground surface detected by the sensor component or for targeted projection of an illumination structure of a grid or of a cross onto at least a part of the ground surface detectable by the sensor component.

11. A sideways drift correction method for correcting the sideways drift of a mobile construction machine on the basis of a reference point of the construction machine, comprising the acts:

optically and continuously detecting a part of the ground surface relative to which the construction machine is moving with a sensor component mounted in a defined orientation relative to a longitudinal axis of the construction machine, the construction machine being moved forward between generated recordings of the ground surface;

recognizing a shift of a selected structural feature of the recorded ground surface by comparison of the recordings;

determining the direction of movement of the reference point relative to the ground from the shift;

continuously checking whether the sensor component is moving only in the direction of the longitudinal axis of the construction machine;

detecting a sideways drift of the construction machine on the basis of the determined direction of movement of the reference point relative to the ground;

deriving steering correction information; and correcting the sideways drift and ensuring that the construction machine moves only in the direction of its longitudinal axis and therefore without drift.

12. A sideways drift correction method according to claim 11, wherein the detection of the ground surface is carried out with a repetition rate of 100 Hz.

13. A mobile construction machine, comprising:

an application of material and a construction tool for processing the applied material; and a sideways drift correction device, including:

a sensor component configured for continuous detection of at least a part of the ground surface relative to which the construction machine is moving, the construction machine being moved forward between generated recordings of the ground surface; and an evaluation component configured to recognize a shift of a selected structural feature of the recorded ground surface by comparison of the recordings and for determining therefrom the direction of movement of a reference point of the construction machine relative to the ground, wherein:

the sensor component is mounted in a defined orientation relative to a longitudinal axis of the construction machine, and the evaluation component is further configured:

to continuously check whether the sensor component is moving only in the direction of the longitudinal axis of the construction machine;

to detect a sideways drift of the construction machine on the basis of the determined direction of movement of the reference point relative to the ground; and to derive steering correction information so that the sideways drift is corrected.

* * * * *